US007743437B2

(12) United States Patent
Reynoso

(10) Patent No.: US 7,743,437 B2
(45) Date of Patent: Jun. 29, 2010

(54) APPARATUS AND METHOD FOR JET AERATION

(75) Inventor: Arturo Reynoso, Azusa, CA (US)

(73) Assignee: G-G Distribution and Development Co., Inc., Valencia, CA (US)

( * ) Notice: Subject to any disclaimer, the term of this patent is extended or adjusted under 35 U.S.C. 154(b) by 228 days.

(21) Appl. No.: 11/454,185

(22) Filed: Jun. 15, 2006

(65) Prior Publication Data

US 2007/0289056 A1 Dec. 20, 2007

(51) Int. Cl.
*A61H 33/02* (2006.01)

(52) U.S. Cl. ..... 4/541.6; 239/538; 239/600

(58) Field of Classification Search ..... 4/541.6, 4/541.4; 239/428.5, 600, 587.1, 443, 538; 285/139.1–139.2
See application file for complete search history.

(56) References Cited

U.S. PATENT DOCUMENTS

| | | | | |
|---|---|---|---|---|
| 4,335,854 | A | 6/1982 | Reynoso | |
| 4,416,030 | A | 11/1983 | Reynoso | |
| 4,508,665 | A | 4/1985 | Spinnett | |
| 4,671,463 | A | 6/1987 | Moreland et al. | |
| 4,985,943 | A | 1/1991 | Tobias et al. | |
| 5,014,372 | A * | 5/1991 | Thrasher et al. | 4/541.6 |
| 5,220,695 | A | 6/1993 | Henkin et al. | |
| 5,291,621 | A | 3/1994 | Mathis | |
| 5,347,664 | A | 9/1994 | Hamza et al. | |
| 5,495,627 | A * | 3/1996 | Leaverton et al. | 4/541.6 |
| 5,526,540 | A | 6/1996 | Johnson | |
| 5,810,262 | A | 9/1998 | Ton | |
| 5,862,543 | A | 1/1999 | Reynoso et al. | |
| 5,915,849 | A | 6/1999 | Dongo | |
| 5,920,925 | A * | 7/1999 | Dongo | 4/541.6 |
| 6,123,274 | A | 9/2000 | Perdreau et al. | |
| 6,141,804 | A | 11/2000 | Pinciaro | |
| 6,263,522 | B1 | 7/2001 | Dongo et al. | |
| 6,264,122 | B1 * | 7/2001 | Perdreau et al. | 239/600 |
| 6,334,224 | B1 * | 1/2002 | Chalberg et al. | 4/541.6 |
| 6,691,336 | B2 * | 2/2004 | Buck | 4/541.6 |
| 6,848,637 | B2 | 2/2005 | Holtsnider | |
| 6,889,916 | B2 * | 5/2005 | Loyd et al. | 239/261 |
| 6,904,626 | B1 * | 6/2005 | Hester et al. | 4/541.6 |
| 6,973,681 | B2 * | 12/2005 | Ayeni et al. | 4/541.6 |
| 7,043,775 | B2 * | 5/2006 | Holtsnider et al. | 4/541.6 |
| 7,127,751 | B2 * | 10/2006 | Lebrun et al. | 4/541.6 |
| 7,140,051 | B2 | 11/2006 | Fort et al. | |
| 7,246,760 | B2 * | 7/2007 | Marty et al. | 239/587.4 |

* cited by examiner

*Primary Examiner*—Robert M Fetsuga
(74) *Attorney, Agent, or Firm*—Larry K. Roberts

(57) ABSTRACT

Jet aerator apparatus and method. The apparatus can include a jet body including a passageway, water conduits, and an air conduit. The jet aerator can include an exit nozzle received in the passageway. The exit nozzle can include lock clips, locking tabs, and stabilizing tabs. The jet aerator can include a jet head coupled to the exit nozzle by the lock clips. The jet head can include a locking rib. The jet aerator can include a jet cover coupled to the exit nozzle. The jet cover can include slots to receive the locking tabs, stepped portions to receive the stabilizing tabs, and lock grooves to receive the locking rib.

6 Claims, 6 Drawing Sheets

APPARATUS AND METHOD FOR JET AERATION

BACKGROUND OF THE INVENTION

In the hot tub and spa market, various types of jets are known for introducing a jet or spray of water and air into the interior of the tub. Conventional jets include those having an apertured ball or sphere, known as an 'eyeball,' that can be adjusted by the user to spray water and air in a desired direction. Other conventional jets include a rotor body having sub-nozzles that spray several water/air jets into the tub. The rotor body rotates about an axis to provide a multi-stream water/air jet pattern that swirls about the axis of the rotor.

SUMMARY OF THE INVENTION

Some embodiments of the invention provide a jet aerator for installation in a tub wall. The jet aerator can include a jet body with a passageway, a water conduit, and an air conduit. The jet aerator can include an exit nozzle received in the passageway. The exit nozzle can include one or more lock clips, one or more locking tabs, and one or more stabilizing tabs. The jet aerator can include a jet head coupled to the exit nozzle by the lock clips. The jet head can include a locking rib. The jet aerator can include a jet cover coupled to the exit nozzle. The jet cover can include one or more slots to receive the locking tabs, one or more stepped portions to receive the stabilizing tabs, and one or more lock grooves to receive the locking rib. The jet cover and the exit nozzle can be rotatable with respect to the jet body and the jet head.

Embodiments of the invention can include a method of operating a jet aerator. The method can include rotating a jet cover and engaging one or more stabilizing tabs of an exit nozzle with one or more stepped portions of the jet cover. The method can also include rotating the exit nozzle and selectively aligning an aperture of the exit nozzle with a water conduit and/or an air conduit of a jet body.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limited. The use of "including," "comprising" or "having" and variations thereof herein is meant to encompass the items listed thereafter and equivalents thereof as well as additional items. The terms "mounted," "connected" and "coupled" are used broadly and encompass both direct and indirect mounting, connecting and coupling. Further, "connected" and "coupled" are not restricted to physical or mechanical connections or couplings, and can include electrical connections or couplings, whether direct or indirect.

Figure 1:
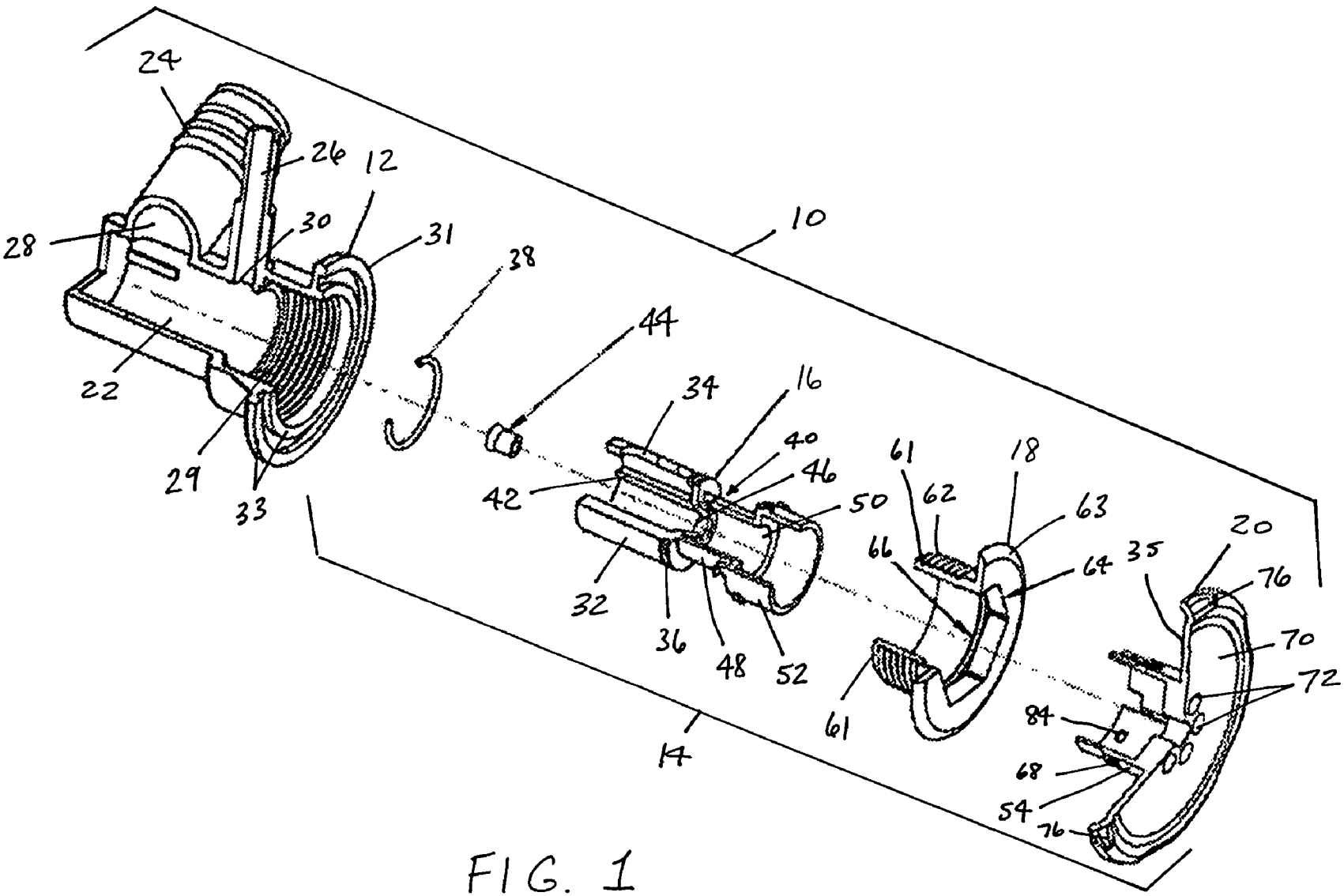
FIG. 1 is an exploded perspective view of a jet aerator according to one embodiment of the invention.
Figure 3:
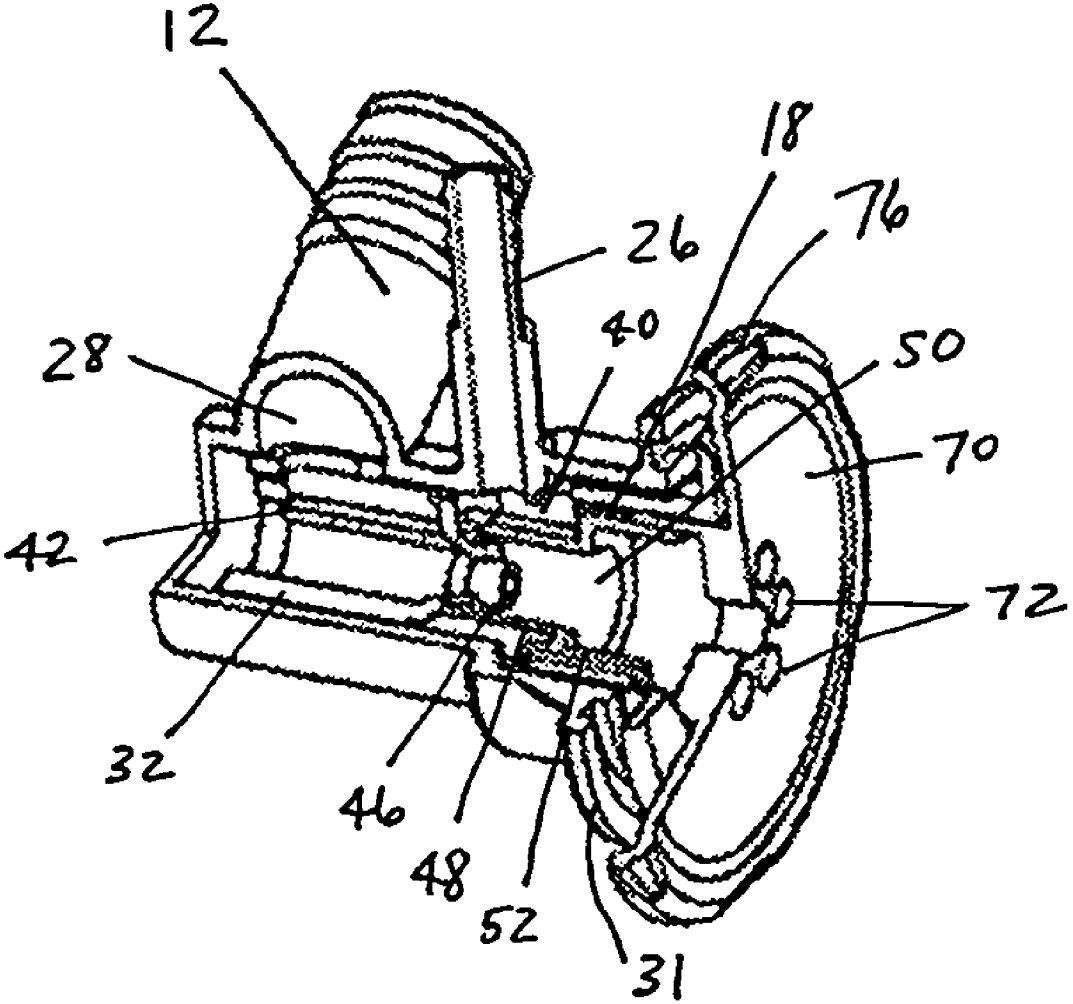
FIG. 3 is a cross-sectional perspective view of the assembled jet aerator of FIG. 1.

FIGS. 1 and 3 illustrate a jet aerator 10 according to one embodiment of the invention for installation in a tub wall (not shown). The jet aerator 10 can be used with a bath tub, a full-size spa, a foot spa, or a pedicure tub. The jet aerator 10 can include a jet body 12 and a nozzle and jet cover assembly 14. The nozzle and jet cover assembly 14 can include an exit nozzle 16, a jet head 18, and a jet cover 20.

Figure 2:
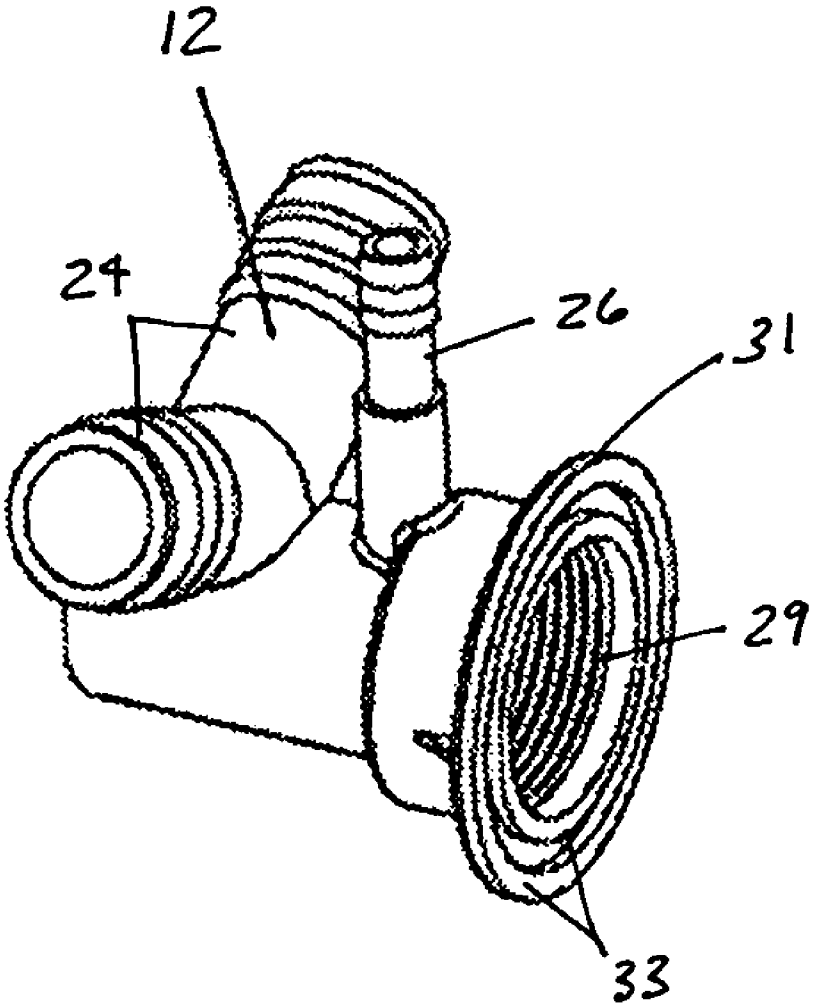
FIG. 2 is a perspective view of a jet body of the jet aerator of FIG. 1.
Figure 6:
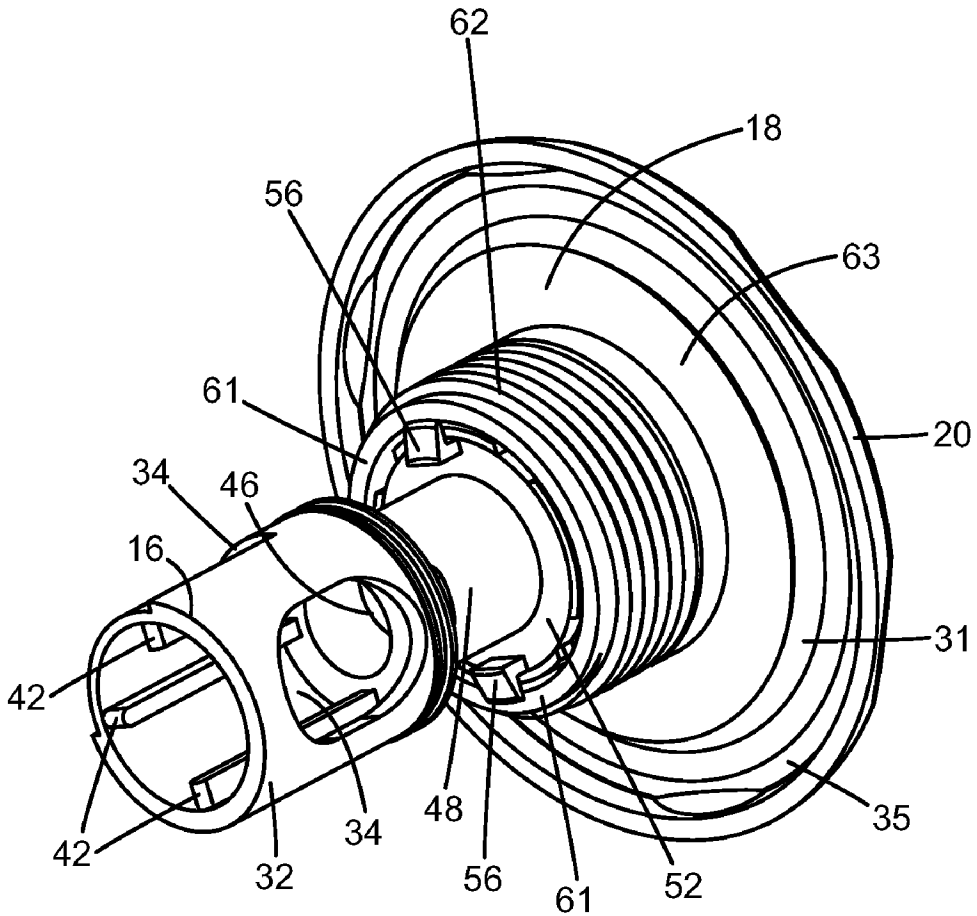
FIG. 6 is a back perspective view of the assembled nozzle and jet cover assembly of FIGS. 4 and 5.

FIGS. 1-3 illustrate the jet body 12, which can be a molded unitary housing defining an elongated passageway 22 for receiving the nozzle and jet cover assembly 14. The jet body 12 can include the passageway 22, one or more water conduits 24 (e.g., for hot and cold water), and an air conduit 26. In some embodiments, the water conduits 24 and the air conduit 26 can be disposed in stacked relation on one side of the passageway 22 in order to conserve space. The passageway 22 can extend to a front portion of the jet body 12. The water conduits 24 can include one or more water opening 28 into the passageway 22, and the air conduit 26 can include an air opening 30 into the passageway 22. The jet body 12 can include a threaded inner diameter portion 29 that can receive and secure the jet head 18. The jet body 12 can also include a flange 31 with one or more outward-facing annular walls 33. The flange 31 can be positioned between a tub wall (not shown) and the jet head 18 and a back side 35 of the jet cover 20, as shown in FIGS. 1 and 6.

Figure 4:
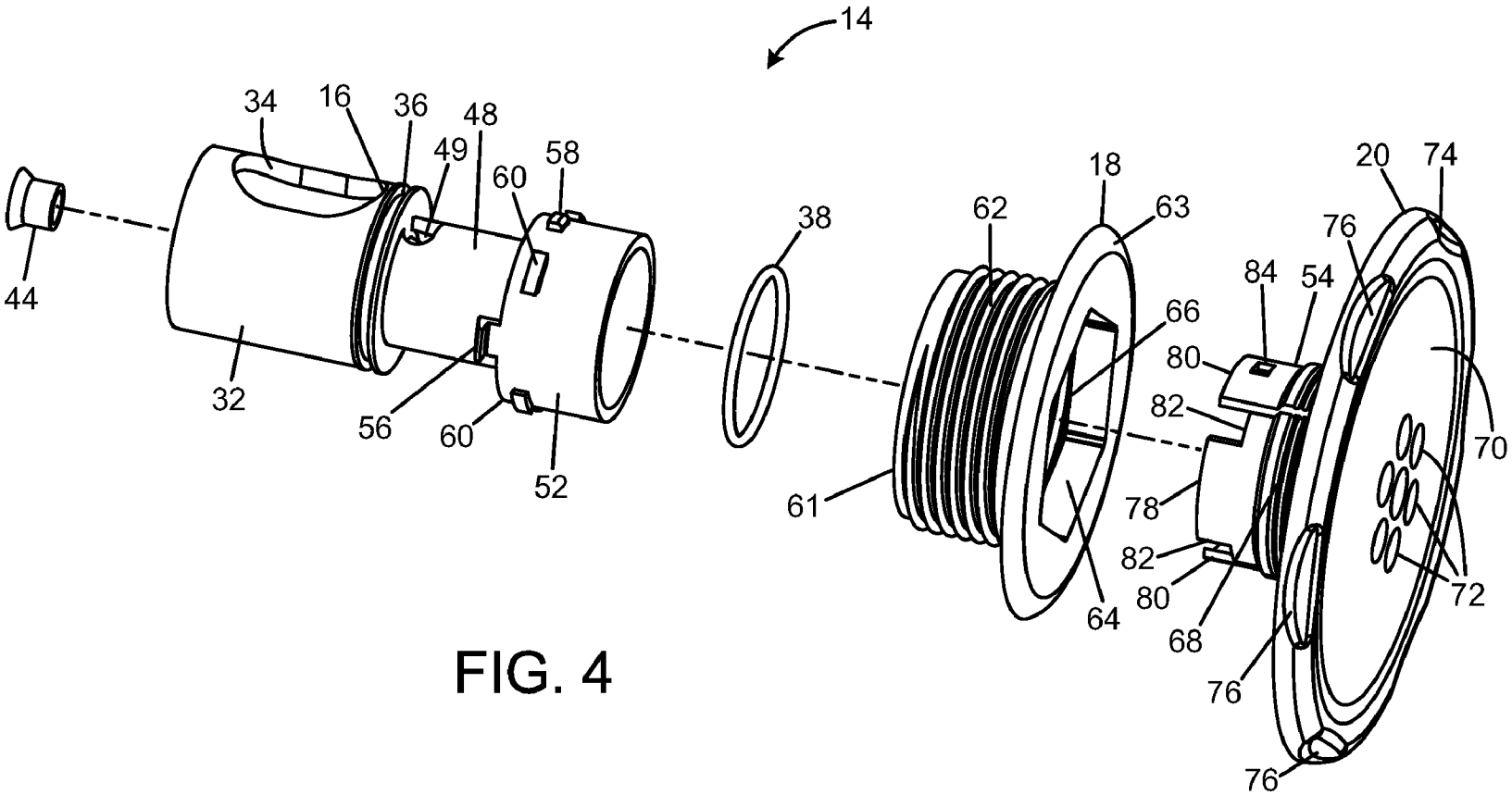
FIG. 4 is an exploded perspective view of a nozzle and jet cover assembly of the jet aerator of FIG. 1.
Figure 5:
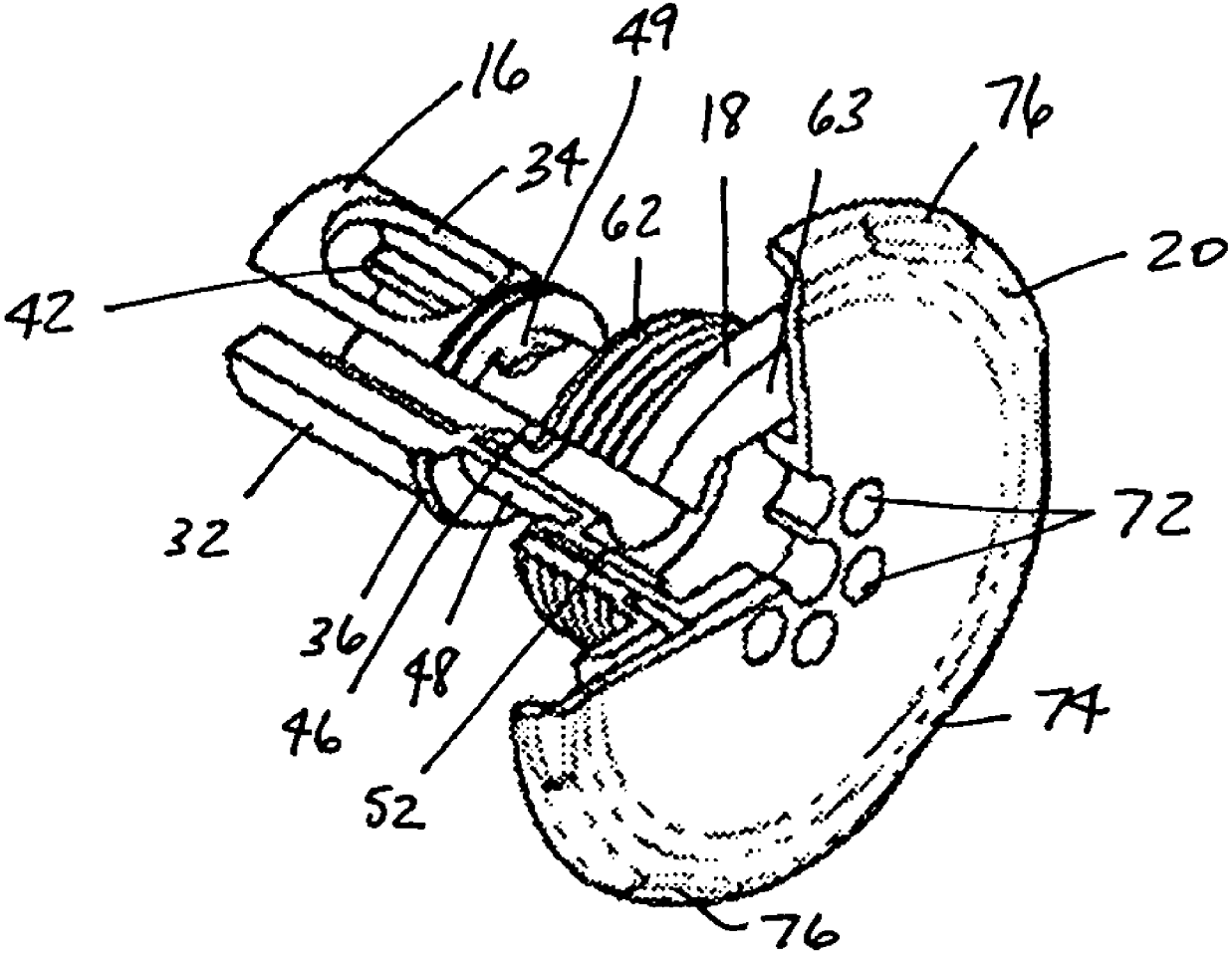
FIG. 5 is cross-sectional front perspective view of the assembled nozzle and jet cover assembly of FIG. 4.

The exit nozzle 16 can be positioned in the passageway 22 of the jet body 12. The water openings 28 and the air opening 30 can communicate with the passageway 22 and the exit nozzle 16. The exit nozzle 16 can include a first portion 32 with one or more apertures 34 that can be selectively aligned with the water openings 28 and the air opening 30 in order to adjust the amount of water and air in the passageway 22. The first portion 32 can also include a seat 36 that can receive a seal 38 in order to define an aerating chamber 40 (as shown in FIG. 3) around a second portion 48 of the exit nozzle 16. In some embodiments, the exit nozzle 16 can be generally cylindrical and the seal 38 can be a flexible cylindrical seal, such as an O-ring. The exit nozzle 16 can include one or more longitudinally-extending interior walls 42. The exit nozzle 16 can include a flow reducer cylinder 44, which can be replaceable, in some embodiments. The exit nozzle 16 can include a metering orifice 46 positioned in a downstream end wall of the first portion 32. The metering orifice 46 can allow water to enter the second portion 48 of the exit nozzle 16. The second portion 48 of the exit nozzle 16 can have a reduced diameter from the first portion 32. The second portion 48 can include an aperture 49 (as shown in FIGS. 4 and 5) that can allow air to enter from the aerating chamber 40 into the interior of the second portion 48, where the air can mix with the water entering through the metering orifice 46. The second portion 48 can include a second orifice 50 positioned in a downstream end wall of the second portion 48. The second orifice 50 can allow mixed water and air to enter a third portion 52 of the exit nozzle 16. The third portion 52 can have an increased diameter from the second portion 48, such as approximately the same diameter as the first portion 32. The third portion 52 of the exit nozzle 16 can be sized to be received by a cylinder 54 of the jet cover 20. As shown in FIG. 4, the third portion 52 of the exit nozzle 16 can include one or lock clips 56, one or more locking tabs 58, and/or one or more stabilizing tabs 60, each of which can engage portions of the jet head 18 and the jet cover 20. The jet head 18 can be coupled to the exit nozzle 16 by the lock clips 56, which are configured to engage the jet head 18 (FIG. 6), constraining the exit nozzle within the passageway. In some embodiments, the exit nozzle 16 can include two lock clips 56 positioned on opposite sides of the exit nozzle 16.

As shown in FIGS. 1 and 4, the jet head 18 can include a threaded outer diameter portion 62 that can receive the threaded inner diameter portion 29 of the jet body 12. As shown in FIG. 6, the lock clips 56 of the exit nozzle 16 can engage an end 61 of the threaded outer diameter portion 62 of the jet head 18. Referring to FIG. 1, a tub wall can be positioned between a back side of a flange 63 of the jet head 18 and the annular walls 33 of the jet body 12. In some embodiments, the flange 63 can have an edge with a bezel. The jet head 18 can be secured to the jet body 12 so that the jet head 18 remains stationary while the exit nozzle 16 and the jet cover 20 can be manually rotated to adjust the flow of water and air. In some embodiments, the exit nozzle 16 and the jet cover 20 are also removable from the jet body 12 (e.g., for cleaning or replacement). In some embodiments, the jet head 18 an include a hexagonal inner diameter portion 64 that can be rotated with a spanner wrench in order to disengage the jet head 18 from the jet body 12. The jet head 18 can also include a locking rib 66 that can engage one or more lock grooves 68 on a cylinder 54 of the jet cover 20. In some embodiments, the cylinder 54 can include three annular lock grooves 68, any one of which can receive the locking rib 66 to provide an appropriate distance between jet head 18 and the jet cover 20.

The jet cover 20 can include a face plate 70 coupled to the cylinder 54. Various types of jet covers 20 can be coupled to the jet body 12, such as eyeball configurations, rotary configurations, multi-port configurations, etc. In some embodiments, the face plate 70 can include one or more discharge apertures 72. The face plate 70 can include an edge 74 with one or more bevels. The edge 74 can include indentations 76 that can be gripped by a user to manually rotate the jet cover 20. As shown in FIG. 4, in some embodiments, the cylinder 54 of the jet cover 20 can include one or more larger sections 78 and one or more smaller sections 80. The larger sections 78 can include one or more stepped portions 82 that can receive the stabilizing tabs 60. In some embodiments, each larger section 78 can include a stepped portion 82 on each corner for a total of four stepped portions 82, and the exit nozzle 16 can include a corresponding four stabilizing tabs 60. The two smaller sections 80 can include one or more slots 84 that can receive the locking tabs 58 of the exit nozzle 16 to form a snap-on jet cover assembly. In some embodiments, the slots 84 can be rectangular and each smaller section 80 can include one slot 84.

The jet cover 20 can be coupled to the jet body 12 by inserting the cylinder 54 of the jet cover 20 into the jet head 18 and lining up the locking tabs 58 with the slots 84 in the smaller sections 80 of the cylinder 54. The jet cover 20 can be pressed toward the exit nozzle 16 until the smaller sections 80 expand over the locking tabs 58 and the locking tabs 58 snap into place within the slots 84. The stabilizing tabs 60 will then slide into the stepped portions 82 of the larger sections 78 of the cylinder 54. Once the jet cover 20 is inserted and snapped over the exit nozzle 16, the locking rib 66 of the jet head 18 can snap into one of the locking grooves 68 of the cylinder 54. In some embodiments, the locking grooves 68 extend around the perimeter of the cylinder 54 by being included in the larger sections 78 and the smaller sections 80 of the cylinder 54. The locking rib 66/locking grooves 68 and the locking clips 56 of the exit nozzle 16 can be substantially independent to provide a dual-locking system between the exit nozzle 16, the jet head 18, and the jet cover 20. The larger sections 78 and the smaller sections 80 can be compressed as the cylinder 54 is inserted into the inner diameter of the jet head 18 and can then expand outward when the locking rib 66 of the jet head 18 snaps into place in one of the locking grooves 68 of the jet cover 20. The locking clips 56 can then expand outward at the end 61 of the threaded outer diameter portion 62 of the jet head 18.

Once installed, the jet cover 20 can be manually adjusted by a user. As the user rotates the jet cover 20, the locking rib 66 of the jet head 18 freely rotates within one of the lock grooves 68 of the cylinder 54. As a result, the jet head 18 does not rotate, but remains stationary with respect to the jet body 12 and the tub wall. However, the stepped portions 82 of the jet cover 20 engage the stabilizing tabs 60 of the exit nozzle 16 so that the exit nozzle 16 rotates with the jet cover 20. As the jet cover 20 and the exit nozzle 16 rotate, the apertures 34 of the exit nozzle 16 can be selectively aligned with respect to the water conduits 28 and the air conduit 26 of the jet body 12 in order to adjust the amount of water and air in the passageway 22.

Various additional features and advantages of the invention are set forth in the following claims.

The invention claimed is:

1. A jet aerator for installation in a tub wall, the jet aerator comprising:

a jet body including a passageway, at least one water conduit, and an air conduit;

an exit nozzle received in the passageway, the exit nozzle including at least one lock clip, at least one locking tab, and at least one stabilizing tab;

a jet head including a locking rib;

a jet cover coupled to the exit nozzle, the jet cover including at least one slot to receive the at least one locking tab, at least one stepped portion to receive the at least one stabilizing tab, and at least one lock groove to receive the locking rib, the jet cover and the exit nozzle rotatable with respect to the jet body and the jet head; and wherein the exit nozzle is constrained within the passageway by engagement of the at least one lock clip with the jet head wherein said at least one locking tab includes a first locking tab and a second locking tab, the at least one slot includes a first rectangular slot and a second rectangular slot, and wherein said first locking tab is received by said first rectangular slot and said second locking tab is received by said second rectangular slot.

2. The jet aerator of claim 1, wherein the jet cover includes a face plate, the face plate including a plurality of discharge apertures in fluid communication with the exit nozzle to allow water and air to pass from the exit nozzle out the jet cover through the discharge apertures.

3. A jet aerator for installation in a tub wall, the jet aerator comprising:

a jet body including a passageway, at least one water conduit, and an air conduit;

an exit nozzle received in the passageway, the exit nozzle including at least one lock clip, at least one locking tab, and at least one stabilizing tab;

a jet head including a locking rib;

a jet cover coupled to the exit nozzle, the jet cover including at least one slot to receive the at least one locking tab, at least one stepped portion to receive the at least one stabilizing tab, and at least one lock groove to receive the locking rib, the jet cover and the exit nozzle rotatable with respect to the jet body and the jet head; and wherein the exit nozzle is constrained within the passageway by engagement of the at least one lock clip with the jet head; and wherein the jet cover includes a cylinder with two larger sections and two smaller sections, wherein each one of the two larger sections includes two stepped portions comprising said at least one stepped portion that receive two stabilizing tabs comprising said at least one stabilizing tab, and wherein each one of the two smaller sections includes one slot comprising said at least one slot.

4. A nozzle and jet cover assembly for use with a jet body installed in a tub wall, the jet body including a passageway, at least one water conduit, and an air conduit, the nozzle and jet cover assembly comprising:

an exit nozzle configured to be received in the passageway, the exit nozzle including at least one lock clip, at least one locking tab, and at least one stabilizing tab;

a jet head including a locking rib; and a jet cover coupled to the exit nozzle, the jet cover including at least one slot to receive the at least one locking tab, at least one stepped portion to receive the at least one stabilizing tab, and at least one lock groove to receive the locking rib, the jet cover and the exit nozzle rotatable with respect to the jet body and the jet head; and wherein the at least one lock clip of the exit nozzle is configured to engage the jet head wherein said at least one locking tab includes a first locking tab and a second locking tab, the at least one slot includes a first rectangular slot and a second rectangular slot, and wherein said first locking tab is received by said first rectangular slot and said second locking tab is received by said second rectangular slot.

5. A nozzle and jet cover assembly for use with a jet body installed in a tub wall, the jet body including a passageway, at least one water conduit, and an air conduit, the nozzle and jet cover assembly comprising:

an exit nozzle configured to be received in the passageway, the exit nozzle including at least one lock clip, at least one locking tab, and at least one stabilizing tab;

a jet head including a locking rib; and a jet cover coupled to the exit nozzle, the jet cover including at least one slot to receive the at least one locking tab, at least one stepped portion to receive the at least one stabilizing tab, and at least one lock groove to receive the locking rib, the jet cover and the exit nozzle rotatable with respect to the jet body and the jet head; and wherein the at least one lock clip of the exit nozzle is configured to engage the jet head; and wherein the jet cover includes a cylinder with two larger sections and two smaller sections, wherein each one of the two larger sections includes two stepped portions comprising said at least one stepped portion that receive two stabilizing tabs comprising said at least one stabilizing tab, and wherein each one of the two smaller sections includes one slot comprising said at least one slot.

6. The nozzle and jet cover assembly of claim 5, wherein the jet cover includes a face plate, the face plate including a plurality of discharge apertures in fluid communication with the exit nozzle to allow water and air to pass from the exit nozzle out the jet cover through the discharge apertures.

* * * * *